United States Patent [19]

Haber

[11] 4,003,197

[45] Jan. 18, 1977

[54] WATCH MONITOR

[76] Inventor: Terry M. Haber, 3050 S. Bristol, No. 8C, Santa Ana, Calif. 92707

[22] Filed: June 9, 1975

[21] Appl. No.: 584,858

[52] U.S. Cl. ..... 58/50 R; 58/23 BA; 58/152 H

[51] Int. Cl.[2] ..... G04B 19/34

[58] Field of Search ..... 58/23 R, 23 BA, 50 R, 58/152 H

[56] References Cited

UNITED STATES PATENTS

| | | | |
|---|---|---|---|
| 3,672,155 | 6/1972 | Bergey et al. | 58/50 R |
| 3,802,182 | 4/1974 | Fujita | 58/50 R |
| 3,841,087 | 10/1974 | Kikuchi | 58/152 H |
| 3,889,459 | 6/1975 | Lu | 58/50 R X |
| 3,898,790 | 8/1975 | Takamune et al. | 58/50 R X |

*Primary Examiner*—Ulysses Weldon
*Attorney, Agent, or Firm*—Ralph B. Pastoriza

[57] ABSTRACT

A crystal controlled digital wristwatch is provided with light emitting diodes in a pattern on its face which are periodically energized by low frequency, low current pulses derived from digital divider networks in the watch to provide blinking lights. When a manual push-button is depressed to illuminate the digital display of the watch, the circuit to the blinking lights is disconnected. The blinking lights serve as a monitor to indicate that the watch is operating correctly. When the battery is drained beyond a given point, the blinking lights are no longer energized advising the user that the battery is low.

8 Claims, 4 Drawing Figures

WATCH MONITOR

This invention relates to wristwatches of the type employing a quartz crystal with suitable divider networks for actuating a read-out such as a digital read-out provided by light emitting diodes or liquid crystals.

BACKGROUND OF THE INVENTION

Essentially, quartz crystal watches of the type with which the present invention is concerned utilize a crystal oscillator having an output frequency which is extremely stable. This frequency is divided down into suitable clock pulses for actuating a digital display on the face of the watch.

Whether the watch employs light emitting diodes or liquid crystal type displays, in each case an illuminating means is required to render the diplay visible. In the case of the light emitting diode display, the diodes normally remain de-energized since energization thereof is the greatest source of power drain and if they remain illuminated, the power cells would have to be replaced too frequently. On the other hand, the liquid crystal displays are visible at all times but they do not exhibit a great deal of contrast and a light is typically incorporated to increase the contrast of the display. Again, the light does not remain on at all times since this would be too great a power drain from the watch battery.

WIth both of the foregoing types of displays, it is accordingly necessary to provide a switch which will close the necessary terminals to effect the desired illumination of the display.

In my copending patent applications, Ser. No. 516,688 filed Oct. 21, 1974, entitled ACTUATING MECHANISMS FOR WRIST INSTRUMENTS; Ser. No. 538,743 filed Jan. 6, 1975, entitled ACCELERATION/DECELERATION ACTUATING MECHANISM FOR WRIST INSTRUMENTS; and Ser. No. 556,335 filed Mar. 7, 1975, entitled WRIST ACTUATED PRESSURE SWITCH FOR WATCHES, there are disclosed quartz crystal type watches as discussed above wherein various types of inertia switch means or pressure switch means are described for rendering the display visible.

Since the display is only illuminated at the time a user wishes to tell the time, the face of the watch is normally dark and appears blank. There is really no convenient means for a user to be advised whether the watch is properly operating unless he actuates the display. Moreover, since the watch face essentially appears blank, the watch itself is generaly inconspicuous and thus would not attract attention as might be the case with an ornate conventional type watch. Finally, there is no readily available observable means of determining how low the battery might be and thus replacement of the battery is often done simply on a fixed time basis regardless of how many times the actuating mechanism for illuminating the readout might be used.

BRIEF DESCRIPTION OF THE PRESENT INVENTION

With all of the foregoing in mind, the present invention contemplates a wristwatch of the foregoing type incorporating features which not only serve to render the watch more attractive by providing it with an attention attracting feature, but wherein proper operation of the watch can be determined at a glance and when the battery is drained beyond a certain point, there is also provided a clear indication to the user of this fact.

Briefly, the foregoing is accomplished in a quartz crystal controlled watch by providing a light emitting means in addition to the normal illuminating means for the display on or near the face of the watch. Means are included in the divider circuit portion of the watch for providing low frequency, low level current pulses derived from the crystal oscillator and connected to the light emitting means for periodically energizing the light emitting means at the low frequency to provide an attention attracting blinking light on the watch.

In the preferred embodiment, the light emitting means takes the form of a plurality of low level light emitting diodes arranged in a desired pattern on the watch face. Each individual light emitting diode is caused to periodically blink providing an attention-arresting feature. The low level light emitting diodes are continuously energized so that it is evident that the watch is operating properly when the lights are blinking. On the other hand, when the battery is drained below a certain point, the blinking lights no longer operate thus advising the user of the watch that the battery is low.

The blinking light arrangement thus serves the dual function of providing an attention attracting display and also a monitor as to the battery drainage.

BRIEF DESCRIPTION OF THE DRAWINGS

A better understanding of the invention will be had by referring to the accompanying drawings in which.

DETAILED DESCRIPTION OF THE INVENTION

Figure 1:
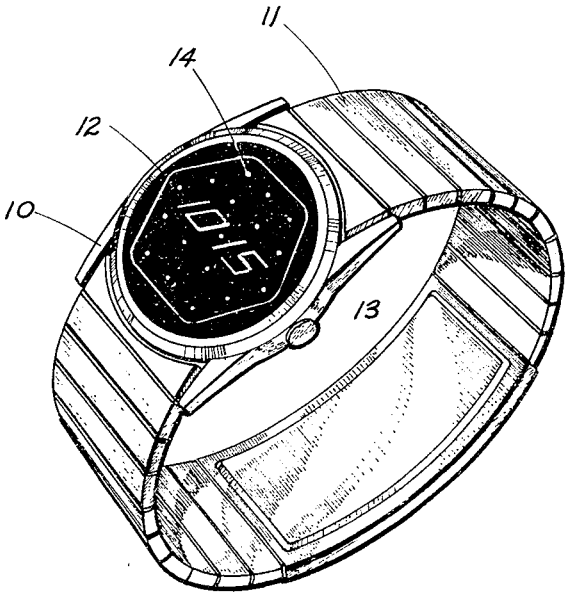
FIG. 1 is a perspective view of a quartz oscillator wristwatch incorporating the blinking lights in accord with the present invention.

Referring to FIG. 1 there is shown a watch 10 having a wristband 11 and time indicating means in the form of a digital read-out display 12. A manually operable push-button 13 is shown for actuating the illuminating means to render the display visible when a user wishes to tell time.

In accord with the invention, there is provided a light emitting means 14 preferably in the form of a plurality of low-level light emitting diodes arranged in a given pattern about the digital read-out 12. As will become clearer as the description proceeds, each of these individual low level light emitting diodes is energized by low frequency, low current pulses so that the various light emitting diodes blink. The energization is continuous so that as long as there is sufficient battery power, they will continuously blink thereby providing an attention attraction feature to the watch.

Figure 2:
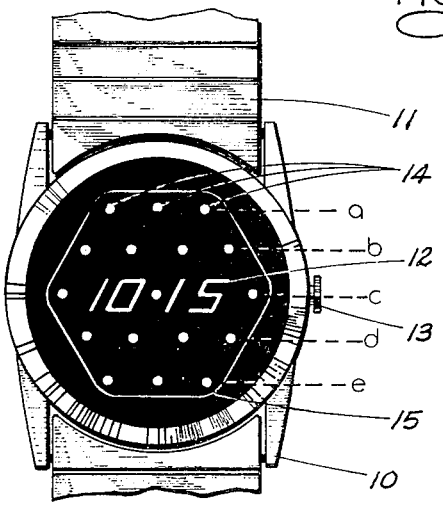
FIG. 2 is a plan view of the face of the watch of FIG. 1 illustrating a first pattern for the blinking lights.

Referring to FIG. 2, the particular pattern of the light emitting diodes illustrated covers the face of the watch with the time indicating means in the form of a digital readout 12 in the central portion of the pattern. Thus, there are provided a plurality of rows of the light emitting diodes 14 as indicated at *a*, *b*, *c*, *d*, and *e*. The numbers of light emitting diodes in each row are 3, 4, 3, 4 and 3 respectively. Two of the light emitting diodes are omitted from the center row to leave room fr the digital read-out. The pattern is outlined by an hexagonal perimeter 15 and is symmetrical with respect to horizontal and vertical axes as shown. Other components of the watch illustrated in FIG. 2 are designated by the same numerals used in FIG. 1.

Figure 3:
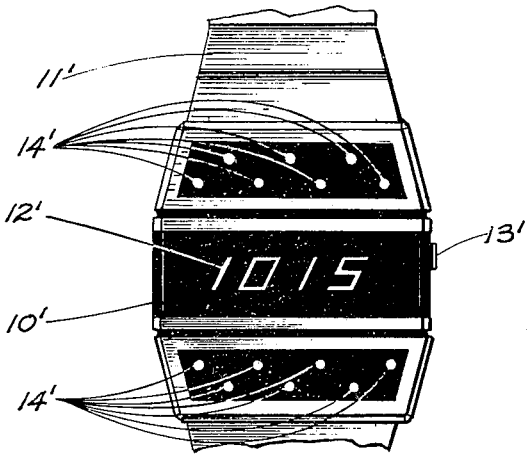
FIG. 3 is a plan view similar to FIG. 2 but illustrating a modified pattern for a somewhat differently designed watch casing; and, FIG. 4 is a simplified block diagram of the basic circuit common to both the watches of FIGS. 2 and 3 for providing the blinking light feature in accord with the present invention.

FIG. 3 shows a modified watch casing structure 10′ provided with a band 11′ and time indicating means in the form of a digital read-out 12′. A push-button 13′ is used for actuating the illuminating means so that whan a user wishes to tell the time, he will depress the button 13′. In the watch of FIG. 3, there are again provided light emitting means in the form of a plurality of light emitting diodes 14′ but in this case, the same are arranged in two sub-patterns respectively adjacent to the top and bottom of the read-out display 12′. As in the case of the light emitting diodes described in conjunction with the watch of FIGS. 1 and 2, each light emitting diode is energized by low frequency, low current pulses to blink.

Figure 4:
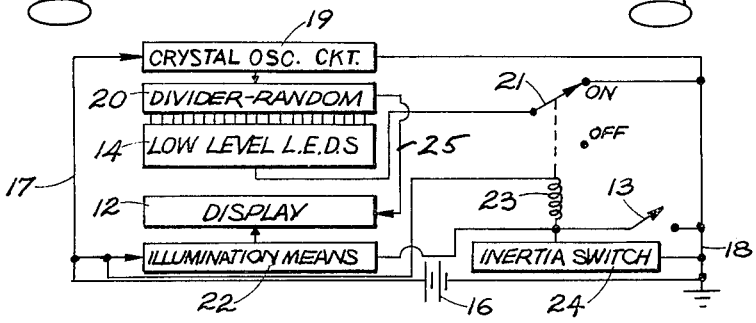

Referring now to FIG. 4, there is shown a schematic block diagram of the basic components common to both of the watches described in FIGS 2 and 3. As shown in the lower central portion of FIG. 4, the watch incorporates a power source such as a battery 16 providing power on output lead 17 to the left of FIG. 4 and return lead 18 which may be grounded to the casing of the watch. A crystal oscillator circuit 19 is connected to the battery source 16 by way of the leads 17 and 18 for continuous energization. A divider circuit means 20 in turn connects to the crystal oscillator circuit for providing timing pulses to control the time indicating means or display 12.

In FIG. 4, the light emitting means in the form of the plurality of low level light emitting diodes 14 in FIG. 2 and 14′ in FIG. 3 are indicated by the same numeral 14 as a box. Means are provided in the divider circuit means 20 for providing low frequency, low level current pulses derived from the crystal oscillator circuit 19 and connected to the light emitting means 14 as indicated by the plurality of vertical lines. A circuit is completed from the low level light emitting diodes 14 through a switch arm 21 to the return lead 18.

The illumination means for the display 12 is indicated by the box 22 connected between the power lead 17 and another switch arm 13 to return lead 18. The switch arm 13 corresponds to the push-button switches 13 and 13′ described in FIGS. 2 and 3 and it will be noted that this switch is normally open. A suitable means which for simplicity is illustrated as a relay coil 23 connects across the illuminating means 22 and is arranged to turn the switch arm 21 from the low level light emitting diodes to an OFF position whenever the illuminating means 22 is energized. When the illuminating means is de-energized, the coil 23 is also de-energized so that the switch arm 21 will reconnect the low level light emitting diodes 14 into the circuit. In the particular embodiment shown in FIG. 4, there is provided an inertia switch 24 connected across the switch arm 13 so that the illuminating means 22 can be actuated by a flick of the wrist. This inertia switch may be of the type shown in any one of my heretofore referred to copending patent applications.

The timing pulses for operating the display 12 are derived from the divider circuit network 20 and passed to the display as indicated by lead 25. The low level light emitting diodes 14, on the other hand, are energized from low frequency, low current pulses as described which are derived from divider portions of the divider network circuit in such a manner and in accord with the preferred embodiment of the invention to individually energize the light emitting diodes in a random manner so that they will blink in a randon manner. It should be understood, however, that the sequence of energizing the light emitting diodes need not be random but could be programmed if desired to follow a specific lighting sequence, for example, 1 second and/or 1 minute intervals.

OPERATION

In operation, and with reference to FIG. 4, it will be appreciated that the crystal oscillator circuit is continuously energized so that proper timing pulses are provided by lead 25 to the display 12. When a user wishes to tell the time, he will depress the normally open push-button switch 13 to close the arm as shown in FIG. 4 and thus actuate the illuminating means 22. The display or time indicating means 12 will then be rendered visible.

Simultaneously with the energization of the illuminating means 22 as described heretofore, the coil 23 will be energized to thereby disconnect the low level light emitting diodes from the circuit by the movement of the switch arm 21 to its OFF position. When the illuminating means 22 is de-energized as by releasing the push-button switch 13, the coil 23 will also be de-energized thereby reconnecting the low level light emitting diodes through the switch arm 21 to the circuit.

If the push-button switch 13 is considered a first switch means to actuate the illuminating means when closed by a user to tell the time, and the switch arm 21 considered a second switch means, it is evident that the second switch means is reponsive to closing of this first switch means to open and disconnect the light emitting means in the form of the light emitting diodes and responsive to opening of the first switch means to close and reconnect the light emitting diodes so that the blinking light or lights stops during the period of time that the first switch means is closed; that is, during the short period of time that a user is telling the time.

From the foregoing it will be evident that an attractive display is provided by the low level light emitting diodes and that further, the light emitting diodes serve as a monitoring means to determine that the watch is properly operating. In the preferred embodiment described, the low level current pulses provided for energizing the low level light emitting diodes are responsive to a given drainage from the battery 16 to no longer have sufficient power to energize the light emitting diodes. As a consequence, the light emitting diodes will stop blinking before the battery is completely drained, thereby giving the user of the watch a warning that the battery is low.

The watch monitor of the present invention accordingly not only provides an attention attracting displsy for the watch but serves to indicate to the user that the watch is properly operating and also provides a warning to the user when the battery is sufficiently low that it should be replaced.

What is claimed is:

1. A watch including a. a time indicating means;

b. a source of electrical energy;

c. a crystal oscillator circuit connected to said source for continuous energization;

d. divider circuit means connected to said crystal oscillator circuit for providing timing pulses to control said time indicating means.

e. light emitting means;

f. means in said divider circuit means for providing low frequency, low level current pulses derived from said crystal oscillator circuit and connected to said light emitting means for periodically energizing said light emitting means at said low frequency to provide an attention attracting blnking light on said watch;

g. illuminating means for rendering visible said time indicating means when actuated;

h. a first switch means connected to actuate said illuminating means when closed by a user to tell the time; and i. a second switch means connected to said light emitting means and responsive to closing of said first switch means to open and disconnect said light emitting means and responsive to opening of said first switch means to close and reconnect said light emitting means so that said blinking light stops during the period of time said first switch means is closed.

2. A watch according to claim 2, in which said source of electrical energy is a battery and said low level current pulses are responsive to a given drainage on said battery to no longer have sufficient power to energize said light emitting means so that said light emitting means will stop blinking before said battery is completely drained thereby giving the user of said watch a warning that the battery is low.

3. A watch according to claim 2, in which said light emitting means constitutes a plurality of low level light emitting diodes arranged in a given pattern and individually energized by said low frequency current pulses to blink.

4. A watch according to claim 3, in which said given pattern covers the face of the watch with the time indicating means constituting a digital display in the central portion of the pattern.

5. A watch according to claim 3, in which said given pattern comprises two mirror image sub-patterns respectively adjacent to the top and bottom of the time indicating means.

6. A watch according to claim 1, in which said first switch means comprises an inertial switch.

7. A watch according to claim 1, in which said first switch means comprises a manually operable switch.

8. A watch according to claim 7 including an inertia switch connected in parallel with said manually operable switch.

* * * * *